US005334444A

United States Patent [19]

Bhoori et al.

[11] Patent Number: 5,334,444

[45] Date of Patent: * Aug. 2, 1994

[54] COMPATIBILIZED POLYPHENYLENE ETHER/POLYAMIDE MONOFILAMENT AND FELT MADE THEREFORM

[75] Inventors: Yousuf M. Bhoori, Edison; Daniel S. Leydon, Succasunna; Paul Gilmore, Mendham, all of N.J.

[73] Assignee: AlliedSignal Inc., Morristown, N.J.

[ * ] Notice: The portion of the term of this patent subsequent to Jul. 6, 2010 has been disclaimed.

[21] Appl. No.: 976,380

[22] Filed: Nov. 25, 1992

Related U.S. Application Data

[63] Continuation-in-part of Ser. No. 814,977, Dec. 24, 1991, Pat. No. 5,225,270.

[51] Int. Cl.[5] ..... D04H 1/08; B32B 19/00; D02G 3/00; C08F 283/08

[52] U.S. Cl. ..... 428/280; 428/357; 428/364; 428/365; 525/390; 525/391; 525/396; 525/397

[58] Field of Search ..... 428/280, 357, 364, 365; 525/390, 391, 396, 397

[56] References Cited

U.S. PATENT DOCUMENTS

| | | | |
|---|---|---|---|
| 3,306,875 | 2/1967 | Hay | 260/47 |
| 3,337,501 | 8/1967 | Bussink et al. | 260/47 |
| 3,379,792 | 4/1968 | Finholt | 260/857 |
| 3,480,580 | 11/1969 | Joyner et al. | 260/29.6 |
| 3,481,910 | 12/1969 | Brunson | 260/78.4 |
| 3,613,258 | 10/1971 | Jamieson | 34/95 |
| 3,787,361 | 1/1974 | Nakashio et al. | 260/47 |
| 4,119,753 | 10/1978 | Smart | 428/234 |
| 4,159,618 | 7/1979 | Sokaris et al. | 57/249 |
| 4,315,086 | 2/1982 | Ueno et al. | 525/391 |
| 4,359,501 | 11/1982 | DiTullio | 428/245 |
| 4,427,734 | 1/1984 | Johnson | 428/234 |
| 4,612,155 | 9/1986 | Wong | 264/176 R |
| 4,732,938 | 3/1988 | Grant et al. | 525/92 |
| 4,751,270 | 6/1988 | Urawa et al. | 525/244 |
| 4,873,276 | 10/1989 | Fuji et al. | 524/153 |
| 4,973,512 | 11/1990 | Stanley et al. | 428/229 |
| 4,995,429 | 2/1991 | Kositzke | 139/383 R |
| 5,225,270 | 7/1993 | Bhoori et al. | 428/280 |

OTHER PUBLICATIONS

Encyclopedia of Chemical Technology, vol. 18, pp. 328–436, 1984.

*Primary Examiner*—George F. Lesmes

*Attorney, Agent, or Firm*—Melanie L. Brown; Roger H. Criss

[57] ABSTRACT

According to the present invention, there is provide a monofilament, based on the total weight of the monofilament composition, (a) from about 10 weight % to about 60 weight % of a functionalized polyphenylene ether, (b) from about 40 weight % to about 90 weight % of a polyamide, and (c) from about 1 weight % to about 30 weight % of a functionalized elastomeric polymer, and industrial conveyer belts fabricated therefrom.

23 Claims, No Drawings

COMPATIBILIZED POLYPHENYLENE ETHER/POLYAMIDE MONOFILAMENT AND FELT MADE THEREFORM

CROSS REFERENCE TO RELATED APPLICATION

This application is a continuation-in-part of application Ser. No. 814,977, filed on Dec. 24, 1991, Now U.S. Pat. No. 5,225,270.

BACKGROUND OF THE INVENTION

1. Field of the Invention

The present invention relates to a polymeric monofilament and to a felt fabricated therefrom.

2. Description of the Prior Art

Polymeric monofilaments, in general, are produced by melt-extrusion processes as is well known in the art. A polymeric resin is melt-extruded into continuous strand monofilaments by an extruder equipped with a monofilament die, and then the resulting monofilaments are quenched to form solid monofilaments. Thereafter, the solid monofilaments are subjected to a stretch drawing process, also known as an orientation process, which includes one or more steps of alternating heat stretching and quenching procedures, to impart physical strength.

Woven endless belts for conveying and guiding products under manufacture are widely utilized in various industrial processes and are one group of numerous applications where polymeric monofilaments are used extensively. Many of such conveyer belt applications involve harsh chemical and temperature environments in which ordinary polymeric materials cannot withstand.

As an illustration of conveyer belt applications in which conveyer belts are exposed to harsh environments, the felts for papermaking machines are described below. A papermaking machine, in essence, is a device for sequentially removing water from paper furnish. A typical papermaking machine is divided into three sections: forming, wet-press, and dryer sections. In the forming section, the slurry of paper furnish and water is deposited on a forming grid and water is drained, leaving a paper web of about 75 weight percent water content. The resulting web is carried into the wet-press section on a felt (wet-press felt) and passed through one or more of nip presses to reduce the water content of the web to below about 65 weight percent. The web is then carried to the dryer section and dried by contacting hot dryer cylinders on a felt (dryer felt) to reduce the water content of the web to below about 8 weight percent.

Although the felts for different sections of papermaking machine must be designed and fabricated to meet specific needs essential to each section, the felts must possess the general characteristics of dimensional stability, resistance to chemical and thermal degradations, resistance to abrasion, resiliency and tenacity. Both metal and synthetic polymers have been used to fabricate the felts with varying degree of success. Metal fabric felts provide superior thermal characteristics, but are difficult to handle, have poor flexural resistance and are prone to chemical attack and corrosion. These disadvantageous characteristics of metal fabric felts led to a wide acceptance of fabric felts made from a variety of synthetic polymers such as polyolefins, polyamides and polyesters. However, such synthetic polymer felts also exhibit certain disadvantages. Polyolefin felts, for example, are dimensionally stable but have low thermal stability and are not resistant to the chemicals utilized in the papermaking process. Felts made from polyesters provide dimensional stability, and are resistant to abrasion and chemicals, but are prone to high temperature hydrolysis. Felts made from polyamides, such as nylon 6 and nylon 6,6, provide abrasion resistance, resiliency and tenacity, but do not have the required dimensional stability.

There are many commercially available specialized synthetic polymers that are useful for the felt application. Currently, one of the most widely used synthetic polymers to fabricate felts for papermaking machines are polyamides having a long carbon-chain, such as nylon 10, nylon 12, nylon 6/10, and nylon 6/12. Such polyamides provide tenacity, resiliency and abrasion resistance as well as dimensional stability. Polyaryletherketone fabrics also have been utilized in the felt applications as disclosed in U.S. Pat. No. 4,359,501 to DiTullio. U.S. Pat. No. 4,159,618 to Sokaris discloses yarns fabricated from liquid-crystal polymers, such as aramides, that are useful in the manufacture of woven felts. Although these specialty polymer felts provide good properties that are required in the papermaking felt applications, the high cost of these specialty polymers precludes wide acceptance of such felts. Consequently, it would be desirable to have less expensive polymeric materials that exhibit the required characteristics suitable for the felt application.

The present inventors investigated polyphenylene ether/polyamide blend compositions to create blend compositions that are highly suited for use in various monofilament and conveyer belt applications. Although, as is known in the art, polyphenylene ethers and polyamides are incompatible polymers and the two polymers must be compatibilized to form blend compositions of any use, there are numerous prior art teachings of polyphenylene ether/polyamide blend molding compositions, e.g., U.S. Pat. Nos. 3,379,792 to Finholts, 4,315,086 to Ueno et al., and 4,732,938 to Grant et al. However, the use of polyphenylene ether/polyamide blends for monofilament applications has not been considered in the prior art. This is because it is known in the art that only the blend compositions of compatible polymers can successfully be fabricated into useful monofilaments without breaking the monofilaments during the stretch drawing process and that the compatibility level attained by the prior art polyphenylene ether/polyamide blend molding compositions are not sufficiently high enough to produce useful monofilaments. The compatibility of the two polymers in the prior art polyphenylene ether/polyamide blend compositions are not so high as to form homogeneous blend, and they contain relatively large domains of one polymer within the continuous matrix of the other polymer. Such partially compatible polyphenylene/polyamide blends cannot be used to produce monofilaments since the extrusion of dimensionally uniform monofilaments from such partially compatible blends is not practical and the resulting monofilaments do not have uniform physical properties throughout the length of the filaments. In addition, the monofilament fabricated from such partially compatible blends cannot successfully be subjected, without breaking the monofilament, to the stretch drawing process, which is a necessary process to impart strength to the monofilament.

It would therefore be desirable to provide highly compatible and homogeneous polyphenylene ether/-polyamide blend compositions that are suitable for fabricating quality monofilaments and conveyer belt fabrics made therefrom.

SUMMARY OF THE INVENTION

According to the present invention, there is provided a monofilament comprising, based on the total weight of the monofilament, (a) from about 10 weight % to about 60 weight % of a functionalized polyphenylene ether, (b) from about 40 weight % to about 90 weight % of a polyamide, and (c) from about 1 weight % to about 30 weight % of a functionalized elastomeric polymer, wherein the monofilament exhibits a tenacity of at least 3 grams per denier as measured in accordance with the ASTM D2256-90 breaking tenacity procedure.

The polyphenylene ether suitable for the present invention preferably has an inherent viscosity between about 0.3 dl/g and about 0.8 dl/g, more preferably between about 0.45 dl/g and about 0.75 dl/g, most preferably between about 0.5 and about 0.7 dl/g, when measured in chloroform at 30° C., and the polyamide suitable for use herein preferably has a reduced viscosity between about 1 dl/g to about 4 dl/g, more preferably between about 1.5 dl/g to about 3.5 dl/g, most preferably between about 1.8 and about 3.0 dl/g, when measured in m-cresol at 25° C.

There is further provided herein a felt formed from a monofilament comprising, based on the total weight of the felt, (a) from about 10 weight % to about 60 weight % of a functionalized polyphenylene ether, (b) from about 40 weight % to about 90 weight % of a polyamide, and (c) from about 1 weight % to about 30 weight % of a functionalized elastomeric polymer.

The monofilament of the present invention is a less costly polymeric monofilament having dimensional stability, abrasion resistance, chemical resistance, hydrolysis resistance and high temperature stability as well as strength and tenacity. The felt of the present invention provides excellent chemical and thermal characteristics that are suitable for varied industrial conveyer belt applications, including the papermaking machine felt applications.

DETAILED DESCRIPTION OF THE INVENTION

As mentioned above, the monofilament of the present invention comprises, based on the total weight of the monofilament, (a) from about 10 weight % to about 60 weight %, more preferably from about 15 weight % to about 50 weight %, most preferably from about 20 to about 40 weight %, of a functionalized polyphenylene ether, (b) from about 40 weight % to about 90 weight %, more preferably from about 45 weight % to about 85 weight %, most preferably from about 50 weight % to about 80 weight %, of a polyamide, and (c) from about 1 weight % to about 30 weight %, more preferably from about 1.5 weight % to about 10 weight percent, most preferably from about 2 weight % to about 5 weight %, of a functionalized elastomeric polymer. The instant monofilament provides dimensional stability, abrasion resistance, chemical resistance, hydrolysis resistance and high temperature stability as well as strength and tenacity, rendering the monofilament to be an excellent polymeric material for use in the industrial conveyer belt applications where the belt is exposed to chemically and thermally harsh environments. The monofilament of the present invention exhibits a tenacity of at least about 3 grams per denier (gpd), preferably at least about 3.5 gpd, more preferably at least 4.0 gpd, as measured in accordance with the ASTM D2256-90 breaking tenacity procedure.

One component of the present monofilament is a polyphenylene ether. Polyphenylene ethers are amorphous, non-polar polymers having excellent electrical and mechanical properties, heat and hydrolysis resistances, and dimensional stability. The polyphenylene ethers useful in the present invention include homopolymers and copolymers represented by the formula:

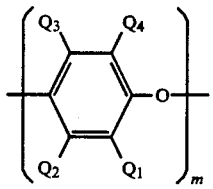

wherein $Q_1$ through $Q_4$ are selected independently of one another from the group consisting of hydrogen and hydrocarbon radicals and m denotes a nun%her of at least 30.

The polyphenylene ethers can be formed by any of a number of catalytic and non-catalytic processes from corresponding phenols or reactive derivative thereof. Examples of such processes of preparing polyphenylene ethers are described in U.S. Pat. Nos. 3,306,875; 3,337,501; and 3,787,361.

Specific examples of suitable substrate phenol compounds include phenol; o-,m-, or p-cresol; 2,6-, 2,5-, 2,4-, or 3,5-dimethylphenol; 2-methyl-6-phenylphenol; 2,6-diphenyl-phenol; 2,6-diethylphenol; 2-methyl-6-ethylphenol; and 2,3,5-,2,3,6- or 2,4,6-trimethylphenol. These phenol compounds may be used as a mixture. Other phenol compounds which can be used include dihydric phenols (e.g., bisphenol A, tetrabromobisphenol A, resorcinol, and hydroquinone).

Preferred polyphenylene ethers suitable for the present invention include poly (2,6-dimethyl-1,4-phenylene ether) , poly ( 2-methyl-1,4-phenylene ether) , poly (3-methyl-1,4-phenylene ether), poly(2,6-diethyl-1,4-phenylene ether) , poly (2,6-dipropyl-1,4-phenylene ether) , poly (2-methyl-6-alkyl -1,4-phenylene ether) , poly (2,6-dichloromethyl-1,4-phenylene ether), poly(2,3,6-trimethyl-l,4-phenylene ether), poly (2,3,5,6-tetramethyl-1,4-phenylene ether), poly(2,6-dichloro -1,4-phenylene ether), poly(2,6-diphenyl-1,4-phenylene ether), poly(2,5-dimethyl-l,4-phenylene ether), and blends and copolymers thereof. Of these, the preferred polyphenylene is poly(2,6-dimethyl-1,4-phenylene ether).

The suitable polyphenylene ether polymers for the present invention are functionalized with a functionalizing compound having a carbon-carbon double bond or triple bond and a functional group selected from the group consisting of carboxylic acids, anhydrides, glycidyl functionalities, and mixtures thereof. The reactive groups may be randomly distributed along the length of or at the ends of the polyphenylene ether chain. The carboxyl or carboxylate functionality can be supplied by reacting polyphenylene ether with a modifier of $\alpha,\beta$-ethylenically unsaturated monocarboxylic acids, such as acrylic and methacrylic acids, as well as dicarboxylic acids having from 4 to 8 carbon atoms. Illustrative of such acid and anhydrides are maleic acid, maleic anhydride, fumaric acid, itaconic acid, itaconic anhydride, and mixtures thereof.

Preferably, the functionalized polyphenylene ether of the present invention contains from about 0.05 to about 5 wt %, more preferably from about 0.1 to about 1.5 wt %, of the functionalizing compound based on the total weight of polyphenylene ether.

The functionalized polyphenylene ether is preferably prepared by melt extruding polyphenylene ether with the functionalizing compound in the presence of from about 0.01 weight % to about 0.2 weight %, more preferably from about 0.05 weight % to 0.1 weight %, of a free radical initiator that helps initiation of the functionalization. Useful free radical initiators include peroxides such as dialkyl, diaryl, and diaryl peroxides, such as dicumyl peroxide and the like. Other useful free radical initiators include N-bromoimides such as N-bromosuccinimide, dialkylazos and the like.

The polyphenylene ether herein may be prefunctionalized using an extruder and pelletized in order to provide a fully functionalized and homogeneous polyphenylene ether composition that can easily be mixed with the rest of the composition constituents. In an alternative, the polyphenylene ether may be functionalized during the final melt-blending process by mixing an unmodified polyphenylene ether, a functionalizing compound and a free-radical initiator along with all other constituents of the present polyphenylene ether/-nylon blend composition, producing the monofilament in a one-step process.

Another component of the present monofilament is a polyamide. Polyamides, also commonly known in the art as nylons, are semi-crystalline, polar polymers having abrasion resistance, strength, toughness and solvent resistance as well as good processibility. The polyamides suitable for the present invention include those which may be obtained by the polymerization of a diamine having two or more carbon atoms between the amine terminal groups with a dicarboxylic acid, or alternately those obtained by the polymerization of a monoamino carboxylic acid or an internal lactam thereof. General procedures useful for the preparation of polyamides are well known to the art, and the details of their formation are well described, for example, under the heading "Polyamides" in the Encyclopedia of Chemical Technology published by John Wiley & Sons, Inc, Vol, 18, pps.328–436, (1984).

Suitable lactams that can be polymerized to produce polyamides include lactam monomers having about 3 to about 12 or more carbon atoms, preferably from about 5 to about 12 carbon atoms. Non-limiting examples of such lactam monomers include propiolactam, epsilon-caprolactam, pyrollidone, poperodone, valerolactam, caprylactam, lauryllactam, etc. Suitable polycaprolactam can be homopolymers of one of the above or similar lactam monomers, or copolymers of two or more of the lactam monomers.

Suitable diamines include those having the formula $$H_2N(CH_2)_nNH_2$$

wherein n preferably is an integer of 1–16, and includes such compounds as trimethylenediamine, tetramethylenediamine, pentamethylenediamine, hexamethylenediamine, octamethylenediamine, decamethylenediamine, dodecamethylenediamine, and hexadecamethylenediarnine; aromatic diamines such as p-phenylenediamine, m-xylenediamine, 4,4'-diaminodiphenyl ether, 4,4'-diaminodiphenyl sulphone, 4,4'-diaminodiphenylmethane, alkylated diamines such as 2,2-dimethylpentamethylenediamine, 2,2,4-trimethylhexamethylenediamine, and 2,4,4-trimethylpentamethylenediamine, as well as cycloaliphatic diamines, such as diaminodicyclohexylmethane, and other compounds.

The dicarboxylic acids useful in the formation of polyamides are preferably those which are represented by the general formula $$HOOC—Z—COOH$$

wherein Z is representative of a divalent aliphatic radical containing at least 2 carbon atoms, such as adipic acid, sebacic acid, octadecanedioic acid, pimelic acid, subeic acid, azelaic acid, undecanedioic acid, and glutaric acid; or a divalent aromatic radical, such as isophthalic acid and terephthalic acid.

By means of example, suitable polyamides include: polypropiolactam (nylon 3), polypyrollidone (nylon 4), polycaprolactam (nylon 6), polyheptolactam (nylon 7), polycaprylactam (nylon 8), polynonanolactam (nylon 9), polyundecaneolactarn (nylon 11), polydodecanolactam (nylon 12), poly(tetramethylenediamine-co-adipic acid) (nylon 4,6), poly(tetramethylenediamine-co-isophthalic acid) (nylon 4,I), polyhexamethylenediamine adipamide (nylon 6,6), polyhexamethylene azelaimide (nylon 6,9), polyhexamethylene sebacamide (nylon 6,10), polyhexamethylene isophthalamide (nylon 6,I), polyhexamethylene terephthalamide (nylon 6,T), polymetaxylene adipamide (nylon MXD: 6), poly (hexamethylenediamine-co-dodecanedioic acid) (nylon 6,12), poly(decamethylenediamine-co-sebacic acid) (nylon 10,10), poly(dodecamethylenediamine-co-dodecanedioic acid) (nylon 12,12),poly(bis[4-aminocyclohexyl]methane-co-dodecanedioic acid) (PACM-12), as well as copolymers of the above polyamides. By way of illustration and not limitation, such polyamide copolymers include: caprolactamhexamethylene adipamide (nylon 6/6,6), hexamethylene adipamide-caprolactum nylon 6,6/6), hexamethylene adipamide/hexamethylene-isophthalamide (nylon 6,6/6IP), hexamethylene adipamide/hexamethylene-terephthalamide (nylon 6,6/6T), trimethylene adipamide-hexamethylene-azelaiamide (nylon trimethyl 6,2/6,2), and hexamethylene adipamide-hexamethylene-azelaiamide caprolactam (nylon 6,6/6,9/6) as well as others polyamide copolymers which are not particularly delineated here. Blends of two or more polyamides may also be employed. Of these, the preferred are polycaprolactam (nylon 6), polyhexamethylene adipamide (nylon 6/6), and copolymers and blends thereof.

As a preferred embodiment, the monofilament of the present invention is fabricated from the monofilament blend composition of the present invention utilizing a high viscosity polyphenylene ether and a high viscosity polyamide. It has surprisingly been found that the tenacity of the monofilament improves significantly without sacrificing other useful physical and chemical properties when high viscosity polyphenylene ether and polyamide are employed in the blend composition. The polyphenylene ether suitable for the present invention preferably has an inherent viscosity between about 0.3 dl/g and about 0.8 dl/g, more preferably between about 0.45 dl/g and 0.75 dl/g, most preferably between about 0.5 dl/g and 0.7 dl/g, as measured in chloroform at 30° C., and the polyamide suitable for use herein preferably has a reduced viscosity between about 1 dl/g to about 4 dl/g, more preferably between about 1.5 dl/g to about 3.5 dl/g, most preferably between about 1.8 dl/g to about 3.0 dl/g, as measured in m-cresol at 25° C.

One further component of the monofilament compositon of the present invention is a functionalized elastomeric polymer. The elastomeric polymers suitable for use herein may be block or graft copolymers, i.e., the elastomeric polymers are made from reactive monomers which form part of the polymer chains or branches, or graft onto the polymer. Such suitable elastomeric polymers include olefinic elastomers, styrenic block copolymers, core/shell rubbers, and mixtures thereof.

An olefinic elastomer is defined as having an ASTM D638 tensile modulus of less than about 40,000 psi (276 MPa), typically less than 25,000 psi (172 MPa), and preferably less than 20,000 psi (138 MPa.). Useful olefinic elastomers include block and graft elastomeric copolymers of one or more of ethylene, propylene, butylene, isopropylene and isobutylene. Preferred olefinic copolymers suitable for use herein are the copolymers of ethylene and at least one $\alpha$-olefin selected from $\alpha$-olefins having 3 to 8 carbon atoms, such as propylene, 1-butene, 1-pentene, 1-hexene, 1-heptene and 1-octene. The copolymers may also contain other monomers such as dienes that are conjugated or nonconjugated. Preferred dienes include butadiene, 1,4-hexadiene, dicyclopentadiene, methylene norborene and the like. Of these copolymers, preferred ethylene/$\alpha$-olefin copolymers are ethylene propylene and ethylene propylene diene copolymers having, based on the ethylene, from about 30 to about 60 weight percent of the $\alpha$-olefin, such as ethylene/propylene rubber, ethylene/1-butene rubber, ethylene/butadiene rubber and the like, and blends thereof. The most preferred is ethylene/propylene rubber.

Elastomeric polymers suitable for the present invention also include styrenic block copolymers. The styrenic block copolymers include diblock copolymers, such as styrene-ethylene/butylene and styrene-ethylene/propylene block copolymers, and triblock copolymers, such as styrene-ethylene/butylene-styrene and styrene-ethylene/propylene-styrene. The styrenic block copolymers suitable for the present invention are commercially available, such as from Shell Chemical Co. under the tradename Kraton.

Another group of elastomeric polymers suitable for the present invention are the core/shell rubbers comprising a core of crosslinked polybutadiene or butyl acrylate copolymer, and a shell of polymethylene methacrylate and optionally styrene and/or acrylonitrile. The core/shell rubbers suitable for the present invention are disclosed, for example, in U.S. Pat. No. 4,495,324, the disclosure of which is hereby incorporated by reference.

According to the present invention, the elastomeric polymer is functionalized with carboxyl or carboxylate functionalities. The functionality can be supplied by reacting the olefinic elastomer with an unsaturated graft moiety taken from the class consisting of $\alpha,\beta$-ethylenically unsaturated dicarboxylic acids having from 4 to 8 carbon atoms and derivatives thereof. Illustrative of such acids and derivatives are maleic acid, maleic anhydride, maleic acid monoethyl ester, metal salts of maleic acid monoethyl ester, fumaric acid, fumaric acid monoethyl ester, itaconic acid, vinyl benzoic acid, vinyl phthalic acid, metal salts of fumaric acid monoethyl ester, monoesters of maleic, fumaric or itaconic acids where the alcohol is methyl, propyl, isopropyl, butyl, isobutyl, hexyl, cyclohexyl, octyl, 2-ethyl hexyl, decyl, stearyl, methoxyethyl, ethoxy ethyl, hydroxy ethyl, and the like. The functional moiety can be grafted to the olefinic elastomers by any graft processes known to the art, including but not limited to the processes described in U.S. Pat. Nos. 3,481,910; 3,480,580; 4,612,155 and 4,751,270. In performing the graft-polymerization of the functional moiety to the elastomers, there have been utilized various methods for initiating the grafting polymerization process such as $\gamma$-ray, X-ray or high-speed cathode ray irradiation processes, and a free-radical initiator process. The preferred functionalized elastomeric polymer of the present invention contains from about 0.05% to about 5% by weight of the functional moiety, more preferably from about 0.1% to about 2%, based on the total weight of the elastomeric polymer.

The monofilament composition may also contain one or more conventional additives known in the art to be suitable for nylon compositions such as stabilizers and inhibitors of oxidative, thermal, and ultraviolet light degradation, lubricants, colorants, including dyes, and pigments, flame-retardants, plasticizers, finishers and the like.

Illustrative of the oxidative and thermal stabilizers suitable for use in the present invention include, for example, Group I metal halides, e.g., sodium, potassium, lithium with cuprous halides, e.g., chloride, bromide, iodide; hindered phenols; hydroquinones; and varieties of substituted members of those groups and combinations thereof.

The monofilament of the present invention may be prepared by conventional polymer melt-blending techniques that blend or mix the constituents to form a uniform dispersion. All of the constituents may be mixed simultaneously or separately utilizing mixing means well known in the art, such as a mixer or extruder. The monofilaments can be produced by a continuous or multi-step process. One of suitable methods for producing the present monofilament is the traditional two-step method, which method comprises melt-kneading a previously dry-blended composition further in a heated extruder provided with a single-screw, or in the alternative, a plurality of screws, extruding the uniform composition into strands, chopping the extruded strands into pellets, and subsequently melt-extruding the pellets in an extruder equipped with a monofilament die to form monofilaments. In an alternative, the dry-blended constituents of the composition is provided to a monofilament forming apparatus which comprises a heated extruder having at least a single screw. The heated extruder melt-blends the monofilament composition, and the resulting melted and thoroughly blended monofilament composition is fed into a metering pump which forces the melted composition through a die to form melted monofilaments. The melted monofilaments are quenched in a waterbath so as to form solid monofilaments. The latter continuous method is preferred since it provides an overall reduction of process and handling steps necessary to form a useful monofilament. The resulting monofilament is subsequently drawn or stretch oriented to impart physical strength. Typical drawing processes comprise one or more cycles of heating the monofilament to a temperature near its softening point and then stretching the softened monofilament to a draw ratio of from about 2:1 to about 6:1, preferably from about 3:1 to about 5:1. The drawn monofilament is quenched and then subjected to a relaxing procedure, which comprises reheating the drawn monofilament, allowing it to relax up to about 15% and quenching to form the finished monofilament.

The resulting monofilament can be fabricated into different industrial conveyer belts of various designs and uses. For example, the monofilament can be fabricated into the felts for use in papermaking machines. Numerous designs for such felts are well known in the art, which include U.S. Pat. No. 3,613,258 to Jamieson et al., U.S. Pat. No. 4,119,753 to Smart, U.S. Pat. No. 4,427,734 to Johnson, U.S. Pat. No. 4,973,512 to Stanley et al., and U.S. Pat. No. 4,995,429 to Kositzke. Felts fabricated from the monofilament of the present invention provides dimensional stability, abrasion and chemical resistances, resiliency, and tenacity, making the felt suitable for use in papermaking machines. The felts of the instant invention is particularly suitable as a press felt for the wet-press section of papermaking machines. In addition, the instant felts exhibit a high thermal stability, rendering the felt suitable for use in the dryer section of papermaking machines as well as in other conveyer belt applications where the belt is exposed to harsh temperature and chemical environments.

The present invention is more fully illustrated by the following example, which is given by way of illustration and not by way of limitation.

EXAMPLE

Example 1

Poly(2,6-dimethyl-1,4-phenylene ether) having 0.51 intrinsic viscosity was intimately blended with nylon 6, fumaric acid, a maleated ethylene/propylene rubber, and N-bromosuccinimide at a weight ratio of 47.75:47:5:0.5:0.05, respectively. A nylon 6 resin having a formic acid viscosity of about 58 and a molecular weight of about 25,000 was employed, which is available from Allied-Signal Inc. The maleated ethylene/propylene rubber used is available from Exxon Chemical under the trademark Exelor® 1803, which rubber contains from 0.5 to 0.9 weight % of maleic anhydride. The blended composition was extruded in a Werner & Pfleiderer ZSK 40 mm twin screw extruder equipped with nine separately heated barrel zones and one die. The extruder temperature profile was 240° C. for zone 1, 280° C. for zones 2–5, 260° C. for zones 6–9, and the die was kept at 275° C. The extruder pressure was 6.89 MPa (1000 psi). The resulting polyphenylene ether/polyamide blend composition was pelletized.

Subsequently, the polyphenylene ether/polyamide pellet was extruded in a single screw extruder, having three zones, equipped with a monofilament die. The temperature profile was 264° C. for zone 1, 266° C. for zones 2–3 and 266° C. for the die. The resulting continuous monofilament was quenched in a waterbath then subjected to a stretch orientation process. The orientation process consisted of drawing and relaxing procedures. The drawing procedure was accomplished by passing the monofilament through a tension roll assembly (tension godet) operated at 20 meters per minute (MPM), an oven heated to 177° C., a draw roll press assembly (draw godet) operated at 61 MPM, an oven heated to 221° C., and a draw roll press assembly operated at 63 MPM, in sequence. The resulting drawn monofilament was subjected to a relaxing procedure by passing it through an oven heated to 229° C. and a relax roll press operated at 58 MPM. The resulting monofilament was oriented to a draw ratio of 4:1 and had a diameter of 0.02 cm (0.008 inches).

The breaking tenacity of the monofilament, measured in accordance with the ASTM D2256-90 testing procedure, was 3.5 grams/denier, indicating that the polyphenylene ether/polyamide monofilament composition of the present invention is a highly compatible blend composition that has a good physical strength and that the resulting monofilament is an excellent monofilament useful for various industrial conveyer belt applications, especially for the papermaking machine felt applications.

The tensile modulus of the monofilament was measured, according to the ASTMD885-85 testing procedure at 70° F. and 65% relative humidity, on the dry-as-extruded and wet-conditioned monofilament samples. The wet-conditioned samples were prepared by submerging the monofilament samples in a waterbath at room temperature for varied durations. The results are shown in Table 1 below.

TABLE 1

| Sample/Condition | Tensile Modulus (gram/denier) |
|---|---|
| Dry-As-Extruded: | 32.1 |
| Wet-Conditioned: | |
| 2 hours | 26.8 |
| 24 hours | 26.5 |
| 48 hours | 26.7 |

As can be seen from the above, the tensile modulus of the monofilament of the present invention does not change after the initial drop even when the monofilament is submerged in water for an extended duration. This is an unexpected advantage of the instant monofilament since the high content of nylon in the composition was expected to render the monofilament to be highly moisture sensitive and the amount of moisture absorbed by the monofilament to be proportional to the duration of exposure to moisture.

Examples 2–11

The monofilaments for Examples 2–11 were prepared in accordance with the procedure outlined in Example 1 utilizing the components listed in Table 2. The monofilaments were drawn to several of draw ratio and tested for their tenacity. The results are shown in Table 2.

TABLE 2

| | Ex 2 | Ex 3 | Ex 4 | Ex 5 | Ex 6 | Ex 7 | Ex 8 | Ex 9 | Ex 10 | Ex 11 |
|---|---|---|---|---|---|---|---|---|---|---|
| | | | Composition (weight %) | | | | | | | |
| PPE[1] | 29.5 | 29.5 | — | — | — | 47.5 | 46.5 | — | — | — |
| PPE[2] | — | — | 29.5 | 29.5 | 29.5 | — | — | 46.5 | 46.5 | 31.5 |
| Nylon 6[3] | 65 | — | — | — | 65 | 47 | 50 | — | 50 | — |
| Nylon 6[4] | — | 65 | 65 | 65 | — | — | — | 50 | — | 65 |
| EPR[5] | 5 | 5 | 5 | 5 | 5 | 5 | 3 | 3 | 3 | 3 |
| Fumaric Acid | 0.5 | 0.5 | 0.5 | 0.5 | 0.5 | 0.5 | 0.5 | 0.5 | 0.5 | 0.5 |
| | | | Tenacity (gram/denier) | | | | | | | |

TABLE 2-continued

| | Ex 2 | Ex 3 | Ex 4 | Ex 5 | Ex 6 | Ex 7 | Ex 8 | Ex 9 | Ex 10 | Ex 11 |
|---|---|---|---|---|---|---|---|---|---|---|
| Draw Ratio: | | | | | | | | | | |
| 2.88 | — | — | — | — | — | 3.10 | 3.24 | — | — | — |
| 3.30 | 3.76 | — | — | — | — | | 3.92 | — | — | — |
| 3.53 | 4.23 | 4.02 | 4.12 | — | 4.17 | | | — | — | — |
| 3.60 | | — | — | — | — | | | — | 3.40 | — |
| 3.67 | | 4.12 | 4.53 | — | 4.39 | | | 3.76 | | — |
| 3.75 | | | — | — | 3.94 | | | | | — |
| 3.80 | | | 4.43 | — | | | | | | 4.70 |
| 3.82 | | | | 4.00 | | | | | | |

[1]Poly(2,6-dimethyl-1,4-phenylene ether) having 0.51 intrinsic viscosity.
[2]Poly(2,6-dimethyl-1,4-phenylene ether) having 0.6 intrinsic viscosity.
[3]Nylon 6 resin having a reduced viscosity of about 1.7 (about 65 formic acid viscosity) and amine terminated.
[4]Nylon 6 resin having a reduced viscosity of about 2.0 (about 90 formic acid viscosity).
[5]Maleated ethylene/propylene rubber, Exelor ® 1803.

The results in Table 2 indicate that the tenacity of the monofilaments increases as the viscosities of polyamide and polyphenylene ether increase.

As discussed before and can be seen from the above examples, the instant monofilament offers dimensional stability, abrasion resistance, chemical resistance, hydrolysis resistance and high temperature stability as well as strength and tenacity, rendering the monofilament to be an excellent polymeric material for use in industrial conveyer belt applications, especially where the belt is exposed to chemically and thermally harsh environments, such as the felts for papermaking machines.

What is claimed is:

1. A monofilament comprising, based on the total weight of the monofilament:

(a) from about 10 weight % to about 60 weight % of a functionalized polyphenylene ether;

(b) from about 40 weight % to about 90 weight % of a polyamide; and (c) from about 1 weight % to about 30 weight % of a functionalized elastomeric polymer, wherein said monofilament exhibits a tenacity of at least 3 grams per denier as measured in accordance with the ATMD2256-90 breaking tenacity testing procedure.

2. The monofilament according to claim 1, wherein said polyphenylene ether is selected from the group consisting of poly(2,6-dimethyl-1,4-phenylene ether), poly (2-methyl-1,4-phenylene ether), poly (3-methyl-1,4-phenylene ether), poly(2,6-diethyl-1,4-phenylene ether), poly (2,6-dipropyl-1,4-phenylene ether), poly(2-methyl-6-alkyl -1,4-phenylene ether), poly(2,6-dichloromethyl-1,4-phenylene ether), poly(2,3,6-trimethyl-1,4-phenylene ether), poly (2,3,5,6-tetramethyl-1,4-phenylene ether), poly(2,6-dichloro -1,4-phenylene ether), poly(2,6-diphenyl-1,4-phenylene ether), poly(2,5-dimethyl-1,4-phenylene ether), and blends and copolymers thereof.

3. The monofilament according to claim 2, wherein said polyphenylene ether is poly(2,6-dimethyl-1,4-phenylene ether).

4. The monofilament according to claim 1, wherein said polyphenylene ether has an inherent viscosity between about 0.3 dl/g and about 0.8 dl/g.

5. The monofilament according to claim 4, wherein said polyphenylene ether has an inherent viscosity between about 0.45 dl/g and about 0.75 dl/g.

6. The monofilament according to claim 1, wherein said polyphenylene ether is functionalized with a functionalizing compound having a carbon-carbon double bond or triple bond and a functional group selected from the group consisting of carboxylic acids, anhydrides, glycidyl functionalities, and mixtures thereof.

7. The monofilament according to claim 1, wherein said functionalized polyphenylene ether contains, based on the total weight of said polyphenylene ether, from about 0.50 wt % to about 5 wt % of a functionalizing compound selected from the group consisting of maleic acid, maleic anhydride, fumaric acid, itaconic acid, itaconic anhydride, and mixtures thereof.

8. The monofilament according to claim 1, wherein said polyamide is selected from the group consisting of nylon 6, nylon 6,6, and blends and copolymers thereof.

9. The monofilament according to claim 1, wherein said polyamide is nylon 6.

10. The monofilament according to claim 1, wherein said polyamide has a reduced viscosity between about 1 dl/g to about 4 dl/g.

11. The monofilament according to claim 10, wherein said polyamide has a reduced viscosity between about 1.5 dl/g to about 3.5 dl/g.

12. The monofilament according to claim 1, wherein said functionalized elastomeric polymer is selected from the group consisting of olefinic elastomers, styrenic block copolymers, core/shell rubbers, and mixtures thereof.

13. The monofilament according to claim 1, wherein said functionalized elastomeric polymer is an ethylene/propylene rubber.

14. The monofilament according to claim 1, wherein said monofilament comprises from about 1.5 wt % to about 10 wt % of said functionalized elastomeric polymer.

15. The monofilament according to claim 1, wherein said functionalized elastomeric polymer contains, based on the total weight of said olefinic elastomer, from about 0.05 wt % to about 5 wt % of a functional moiety selected from the group consisting of $\alpha,\beta$-ethylenically unsaturated dicarboxylic acids having from 4 to 8 carbon atoms and derivatives thereof.

16. The monofilament according to claim 1, wherein said monofilament has a breaking tenacity of at least 3.5 grams per denier.

17. The monofilament according to claim 1, wherein said monofilament has a breaking tenacity of at least 4 grams per denier.

18. A felt formed from a monofilament comprising, based on the total weight of said monofilament:

(a) from about 10 weight % to about 60 weight % of a functionalized polyphenylene ether;

(b) from about 40 weight % to about 90 weight % of a polyamide; and (c) from about 1 weight % to about 30 weight % of a functionalized elastomeric polymer, wherein said monofilament exhibits a tenacity of at least 3 grams per denier as measured in accordance with the ASTMD2256-90 breaking tenacity testing procedure.

19. The felt according to claim 18, wherein said polyphenylene ether is selected from the group consisting of poly(2,6-dimethyl-1,4-phenylene ether), poly (2 -methyl-1,4 -phenylene ether), poly (3 -methyl-1,4-phenylene ether), poly (2,6-diethyl-1,4-phenylene ether), poly (2,6-dipropyl-1,4-phenylene ether), poly(2-methyl-6-alkyl -1,4-phenylene ether), poly(2,6-dichloromethyl-1,4-phenylene ether), poly(2,3,6-trimethyl-1,4-phenylene ether), poly (2,3,5,6-tetramethyl-1,4-phenylene ether), poly(2,6-dichloro -1,4-phenylene ether), poly(2,6-diphenyl-1,4-phenylene ether), poly(2,5-dimethyl-1,4-phenylene ether), and blends and copolymers thereof.

20. The felt according to claim 18, wherein said polyphenylene ether is functionalized with a functionalizing compound having a carbon-carbon double bond or triple bond and a functional group selected from the group consisting of carboxylic acids, anhydrides, glycidyl functionalities, and mixtures thereof.

21. The felt according to claim 18, wherein said polyamide is selected from the group consisting of nylon 6, nylon 6,6, and blends and copolymers thereof.

22. The felt according to claim 18, wherein said functionalized elastomeric polymer is selected from the group consisting of olefinic elastomers, styrenic block copolymers, core/shell rubbers, and mixtures thereof, and is functionalized with a functional moiety selected from the group consisting of $\alpha,\beta$-ethylenically unsaturated dicarboxylic acids having from 4 to 8 carbon atoms and derivatives thereof.

23. A papermaking machine felt formed from a monofilament comprising, based on the total weight of the monofilament:

(a) from about 10 weight % to about 60 weight % of a functionalized polyphenylene ether;

(b) from about 40 weight % to about 90 weight % of a polyamide; and (c) from about 1 weight % to about 30 weight % of a functionalized elastomeric polymer, wherein said monofilament exhibits a tenacity of at least 3 grams per denier as measured in accordance with the ASTM D2256-90 breaking tenacity testing procedure.

* * * * *

UNITED STATES PATENT AND TRADEMARK OFFICE

CERTIFICATE OF CORRECTION

PATENT NO. : 5,334,444

DATED : August 2, 1994

INVENTOR(S) : Yousuf M. Bhoori, Daniel S. Leydon and Paul Gilmore

It is certified that error appears in the above-identified patent and that said Letters Patent is hereby corrected as shown below:

Column 11, line 41: Change "ATMD2256-90" to -- ASTM D2256-90 --.

Column 13, line 5: Change "ASTMD2256-90" to -- ASTM D2256-90--.

Signed and Sealed this

Ninth Day of July, 1996

*Attest:*

*Attesting Officer*

BRUCE LEHMAN

*Commissioner of Patents and Trademarks*